US007450875B2

(12) United States Patent
Watanabe et al.

(10) Patent No.: US 7,450,875 B2
(45) Date of Patent: Nov. 11, 2008

(54) SHEET POST-PROCESSING APPARATUS, IMAGE FORMING SYSTEM AND POWER SAVING CONTROL METHOD

(75) Inventors: Naoto Watanabe, Kashiwa (JP); Takayuki Fujii, Toshima-ku (JP); Shunsuke Nishimura, Toride (JP); Yushi Oka, Abiko (JP); Toshiyuki Miyake, Toride (JP); Takashi Yokoya, Kashiwa (JP); Manabu Yamauchi, Kashiwa (JP)

(73) Assignee: Canon Kabushiki Kaisha (JP)

( * ) Notice: Subject to any disclaimer, the term of this patent is extended or adjusted under 35 U.S.C. 154(b) by 181 days.

(21) Appl. No.: 11/467,254

(22) Filed: Aug. 25, 2006

(65) Prior Publication Data

US 2007/0047998 A1 Mar. 1, 2007

(30) Foreign Application Priority Data

Aug. 30, 2005 (JP) ..... 2005-250115

(51) Int. Cl.
*G03G 15/00* (2006.01)

(52) U.S. Cl. ..... 399/88; 399/81; 399/82; 399/407

(58) Field of Classification Search ..... 399/88, 399/75, 38, 9, 407, 37, 82, 81
See application file for complete search history.

(56) References Cited

U.S. PATENT DOCUMENTS

| | | | | |
|---|---|---|---|---|
| 2004/0022550 | A1 * | 2/2004 | Okada | 399/88 |
| 2004/0096235 | A1 * | 5/2004 | Isobe | 399/88 |
| 2004/0175200 | A1 * | 9/2004 | Namura | 399/88 |
| 2006/0083534 | A1 * | 4/2006 | Ogura | 399/88 |

FOREIGN PATENT DOCUMENTS

JP 11139677 A 5/1999

OTHER PUBLICATIONS

Machine translation of JP 11-139677 A dated Apr. 20, 2008.*

* cited by examiner

*Primary Examiner*—Sophia S Chen
(74) *Attorney, Agent, or Firm*—Rossi, Kimms & McDowell, LLP

(57) ABSTRACT

A sheet post-processing apparatus has a sheet conveying portion which receives and conveys a sheet discharged from an apparatus on an upstream side, and discharges it to an apparatus on a downstream side or a discharge tray, a sheet post-processing portion which carried out post-processing on the sheet, and a power saving control portion which renders the sheet post-processing apparatus into a power saving state, and the power saving control portion maintains electric power supply to the sheet conveying portion, and interrupts electric power supply to the sheet post-processing portion. The sheet post-processing apparatus, even in the power saving state, is capable of discharging the sheet discharged from the apparatus on the upstream side to the apparatus on the downstream side or a discharge tray.

5 Claims, 10 Drawing Sheets

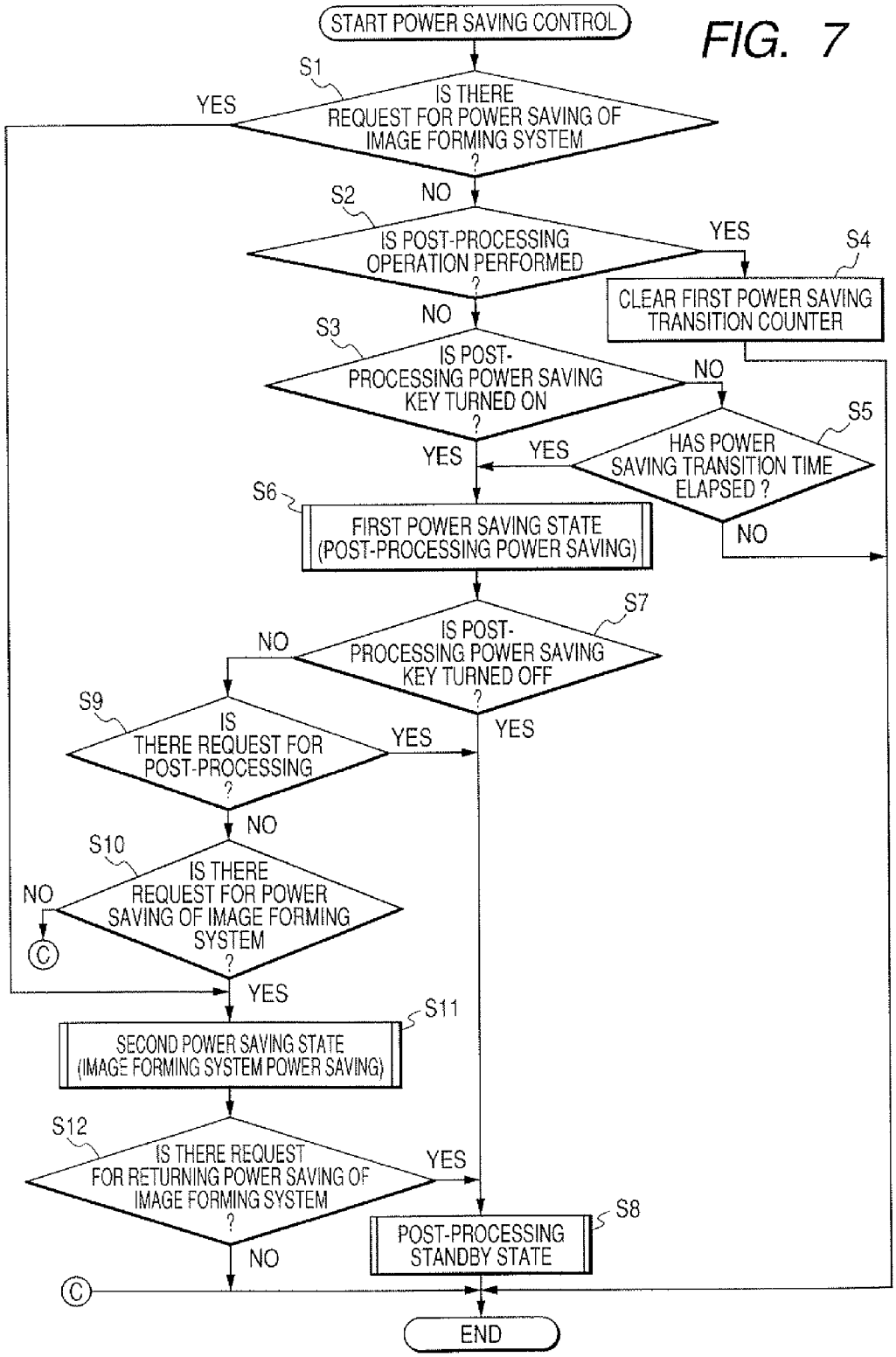
START POWER SAVING CONTROL
FIG. 7
S1
IS THERE REQUEST FOR POWER SAVING OF IMAGE FORMING SYSTEM ?
YES
NO
S2
IS POST-PROCESSING OPERATION PERFORMED ?
YES
S4
CLEAR FIRST POWER SAVING TRANSITION COUNTER
NO
S3
IS POST-PROCESSING POWER SAVING KEY TURNED ON ?
NO
S5
HAS POWER SAVING TRANSITION TIME ELAPSED ?
YES
YES
NO
S6
FIRST POWER SAVING STATE (POST-PROCESSING POWER SAVING)
S7
IS POST-PROCESSING POWER SAVING KEY TURNED OFF ?
NO
YES
S9
IS THERE REQUEST FOR POST-PROCESSING ?
YES
NO
S10
IS THERE REQUEST FOR POWER SAVING OF IMAGE FORMING SYSTEM ?
NO
C
YES
S11
SECOND POWER SAVING STATE (IMAGE FORMING SYSTEM POWER SAVING)
S12
IS THERE REQUEST FOR RETURNING POWER SAVING OF IMAGE FORMING SYSTEM ?
YES
NO
S8
POST-PROCESSING STANDBY STATE
C
END

SHEET POST-PROCESSING APPARATUS, IMAGE FORMING SYSTEM AND POWER SAVING CONTROL METHOD

BACKGROUND OF THE INVENTION

1. Field of the Invention

The present invention relates to power saving control in an image forming system having an image forming apparatus and a post-processing apparatus for carrying out post-processing on a sheet outputted from the image forming apparatus.

2. Description of the Related Art

As described in Japanese Patent Application Laid-open No. H11-139677, there is a system which is provided with an image forming apparatus of an electrophotographic printing method and a post-processing apparatus for carrying out a stapling process, adhesive bookbinding, etc., and which shifts the post-processing apparatus to a power saving state in operative association with the power saving of the image forming apparatus to thereby realize power saving.

Also, in recent years, a large-scale image forming system in which a plurality of post-processing apparatuses are connected in tandem to an image forming apparatus to thereby realize a wide variety of functions including a bookbinding function has been proposed for a print on-demand market. FIG. 10 of the accompanying drawings schematically shows the construction of the conventional large-scale image forming system. This image forming system is of a construction in which an image forming apparatus 1201, a large-capacity paper deck 1202, a sorting apparatus 1203, a stacker 1204 and a finisher 1205 are connected together in series. In this image forming system, the power saving of the entire image forming system is achieved by bring about a power saving state in which a post-processing apparatus is not operated in operative association with the power saving of the image forming apparatus when the image forming apparatus has been brought into an unused state.

In the above-described conventional image forming system, however, the post-processing apparatus could not singly be shifted to the power saving state, irrespective of the operative state of the image forming system. Therefore, in a post-processing apparatus such as, for example, an adhesive bookbinding apparatus provided with a heating heater for melting paste and high in electric power consumption, wasteful electric power has been consumed by the heating heater being normally rendered ON even when only an operation of delivering a sheet to a downstream post-processing apparatus is performed.

Thus, heretofore, an upstream post-processing apparatus could not be shifted to a power saving state in which only the delivery of the sheet to the downstream post-processing apparatus is possible and therefore, electric power has been wastefully consumed.

SUMMARY OF THE INVENTION

It is an object of the present invention to provide a sheet post-processing apparatus, an image forming system and a power saving control method which solve the above-noted problem.

It is another object of the present invention to provide a sheet post-processing apparatus, an image forming system and a power saving control method which can enhance power saving efficiency by shifting post-processing apparatuses individually to a power saving state even if the image forming system is in an operative state wherein it is conveying a sheet.

According to an aspect of the present invention, there is provided a sheet post-processing apparatus connected to an image forming apparatus, comprising: a sheet conveying portion which receives a sheet discharged from an apparatus on an upstream side, conveys the sheet, and discharges the sheet to an apparatus on a downstream side or a discharge tray; a sheet post-processing portion which carries out post-processing on the sheet; and a power saving control portion which renders the sheet post-processing apparatus into a power saving state, wherein the power saving control portion maintains electric power supply to the sheet conveying portion and interrupts electric power supply to the sheet post-processing portion, and the sheet post-processing apparatus, even in the power saving state, is capable of discharging a sheet which is discharged from the apparatus on the upstream side to the apparatus on the downstream side or the discharge tray.

Further features of the present invention will become apparent from the following description of exemplary embodiments with reference to the attached drawings.

BRIEF DESCRIPTION OF THE DRAWINGS

FIG. 7 is a flow chart showing a power saving control process procedure in the image forming system.

DESCRIPTION OF THE EMBODIMENT

An embodiment of the present invention will hereinafter be described with reference to the accompanying drawings. An image forming system according to the present embodiment is applied to an image forming system having an adhesive bookbinding (case binding) function.

(General Construction)

Figure 1:
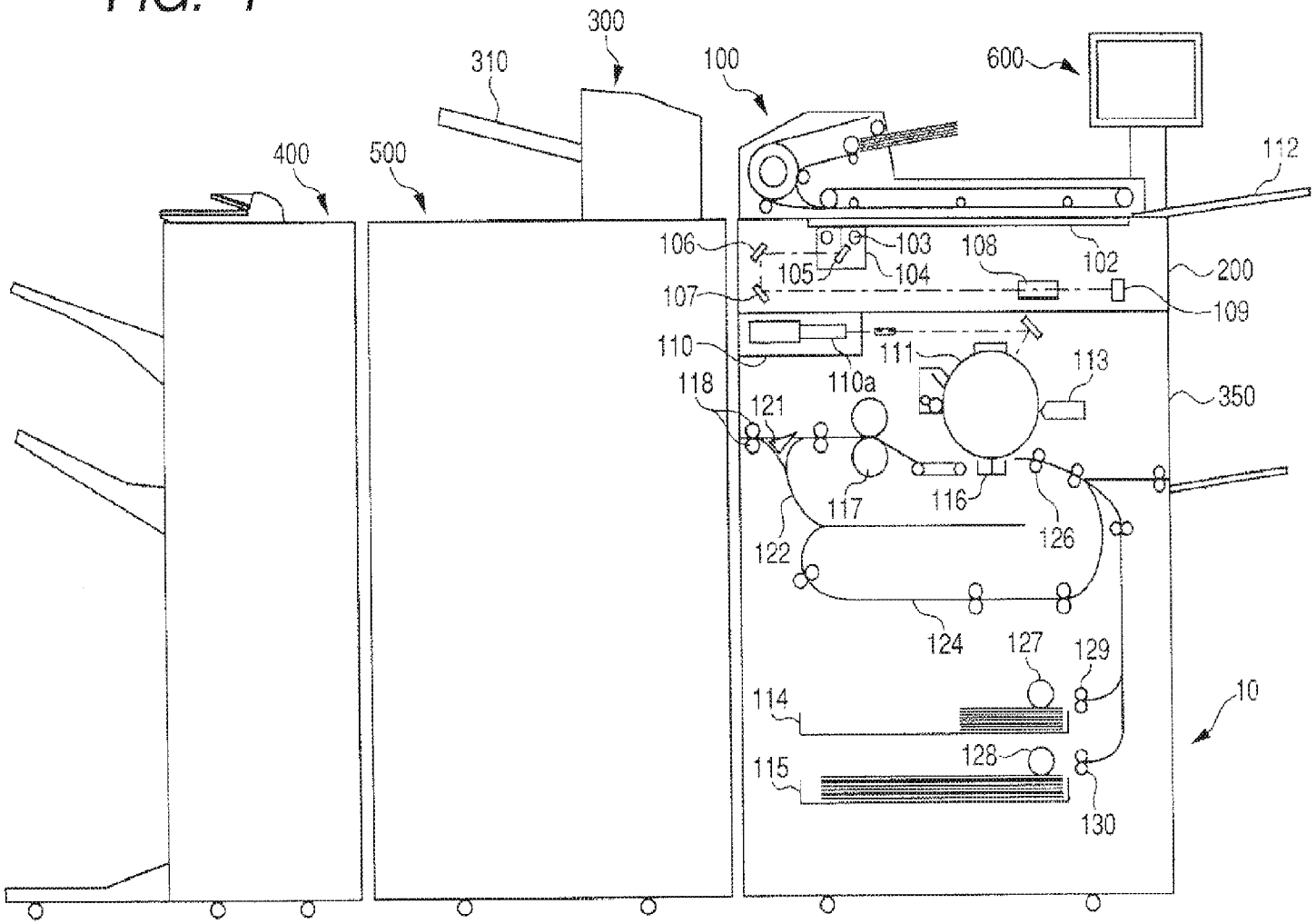
FIG. 1 shows the general construction of an image forming system according to an embodiment of the present invention.

FIG. 1 shows the general construction of the image forming system according to the present embodiment. The image forming system is comprised of an image forming apparatus 10, an adhesive bookbinding machine (case binding machine) 500 and a finisher apparatus 400. The image forming apparatus 10 has an image reader 200 for reading the image of an original, a printer 350 for forming the read image on recording paper, and an operation portion 600 for receiving an operation input by an operator.

An original feeding apparatus 100 is carried on the image reader 200. Originals are set on the original tray of the original feeding apparatus 100 with the first page thereof facing upwardly. The original feeding apparatus 100 feeds the originals one by one from the first page to the left side of FIG. 1, conveys them from the left side to the right side on platen glass (an original plate) 102 through a curved path, and thereafter discharges them toward an outside sheet discharge tray 112.

When the original passes a flow-reading position on the platen glass 102, the image of the original is read by a scanner unit 104 being stopped at a position corresponding to the flow-reading position. This reading method is a method called the so-called original flow-reading. Specifically, when the original passes the flow-reading position, the read surface of the original is irradiated with the light of the lamp 103 of the scanner unit 104, and reflected light from the original is directed to a lens 108 via mirrors 105, 106 and 107. The light passed through this lens 108 is imaged on the image pickup surface of an image sensor 109.

Thus, there is effected original reading and scanning with a direction orthogonal to the conveyance direction of the original as a main scanning direction, and with the conveyance direction as a sub-scanning direction. That is, when the original passes the flow-reading position, the original is conveyed in the sub-scanning direction while the image of the original is read on each line in the main scanning direction by the image sensor 109, whereby the reading of the entire image of the original is effected. Image data outputted from the image sensor 109 is inputted as a video signal to the exposure control portion 110 of the printer 350.

It is also possible to convey the original onto the platen glass 102 by the original feeding apparatus 100 and stop the original at a predetermined position, and scan the scanner unit 104 from the left to the right in this state to thereby read the original. This reading method is a method called the so-called original fixed-reading.

When the original is to be read without the use of the original feeding apparatus 100, a user lifts the original feeding apparatus 100 and places the original on the platen glass 102. Then, the scanner unit 104 scans from the left to the right, whereby the reading of the original is effected.

The exposure control portion 110 in the printer 350 modulates and outputs a laser beam on the basis of a video signal inputted from the image reader 200. This laser beam is applied onto a photosensitive drum 111 while being scanned by a polygon mirror 110*a*. An electrostatic latent image according to the scanned laser beam is formed on the photosensitive drum 111.

This electrostatic latent image on the photosensitive drum 111 is visualized as a developer image with a developer supplied from a developing device 113.

On the other hand, a sheet is fed from an upper cassette 114 or a lower cassette 115 provided in the printer 350 by a pickup roller 127 or 128. The sheet thus fed is conveyed to registration rollers 126 by sheet feeding rollers 129 or 130. In a predetermined time after the leading edge of the sheet has arrived at the registration rollers 126, the registration rollers 126 are driven, and the sheet is conveyed to between the photosensitive drum 111 and a transferring portion 116.

The developer image visualized on the photosensitive drum 111 is transferred onto the fed sheet by the transferring portion 116. The sheet to which the developer image has been transferred is conveyed to a fixing portion 117. The fixing portion 117 heats and pressurizes the sheet to thereby fix the developer image on the sheet. The sheet which has passed through the fixing portion 117 is discharged from the printer 350 toward the adhesive bookbinding machine 500 via a flapper 121 and discharge rollers 118.

Here, when the sheet is discharged in a face-down state, the sheet passed through the fixing portion 117 is once directed into a reversal path 122 by the switching operation of the flapper 121. After the trailing edge of the sheet has passed the flapper 121, the sheet is switched back and is discharged from the printer 350 by the discharge rollers 118.

This sheet discharge form is called reversal sheet discharge. The reversal sheet discharge is effected when images are formed in succession from the first page in a case where an image read by the use of the original feeding apparatus 100 is formed or a case where an image outputted from a computer is formed. The order of the pages of the sheets after discharged becomes a correct page order.

Also, when an image is to be formed on hard paper such as an OHP sheet or thick paper, the paper is not directed to the reversal path 122, but is discharged by the discharge rollers 118 with its image-formed surface facing upward (face-up). Further, when two-side recording in which images are to be formed on the two sides of a sheet is set, the sheet is directed to the reversal path 122 by the switching operation of the flapper 121, and thereafter is conveyed to a two-side conveying path 124. Then, the sheet directed to the two-side conveying path 124 is again fed to between the photosensitive drum 111 and the transferring portion 116 at timing similar to that in the case of one-side recording. The sheet discharged from the printer 350 is conveyed to the adhesive bookbinding machine 500.

(Adhesive Bookbinding Machine)

Figure 2A:
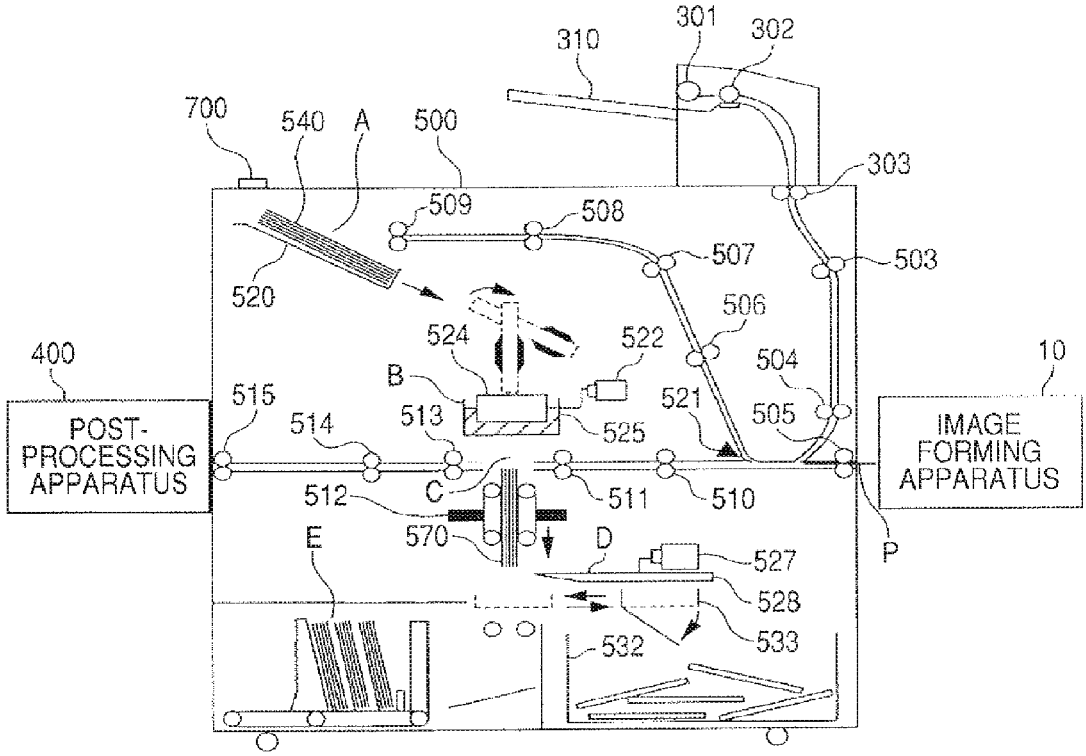
FIG. 2A shows the internal construction of an adhesive bookbinding machine 500.
Figure 2B:
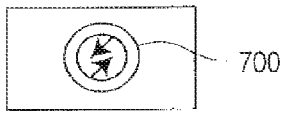
FIG. 2B shows the power saving key of a post-processing apparatus.

FIG. 2A shows the internal construction of the adhesive bookbinding machine 500. FIG. 2B shows the power saving key of a post-processing apparatus. The adhesive bookbinding machine 500 has a sheet stacking portion A for stacking thereon recording sheets discharged from the image forming apparatus 10 and making a sheet bundle, a pasting portion B for effecting pasting on the stacked bundle, an adhesively securing portion C for adhesively securing the pasted stacked bundle and a cover together, a paper cutting portion D for cutting three other directions than the pasted surface in order to effect the alignment of the bookbound end after the adhesive securing of the cover, and a bound book discharging portion E for discharging the finished bound book.

Also, the adhesive bookbinding machine 500 can be shifted to a first power saving state in which a high power saving effect is obtained, by setting the electric power of the loads of the sheet stacking portion A, the pasting portion B, the adhesively securing portion C, the paper cutting portion D and the bound book discharging portion E used for the bookbinding process to OFF, and setting it to a state in which only the conveyance to a downstream apparatus is possible. On the upper surface of the housing of the adhesive bookbinding machine 500, there is disposed a post-processing power saving key 700 for manually instructing the user to shift the adhesive bookbinding machine to the first power saving state, and return it from the first power saving state. Also, this post-processing power saving key 700 is changed over in its ON/OFF of the power saving state each time it is depressed. Also, the post-processing power saving key 700 has a light emitting diode therein, and is turned on when shift is made to the first power saving state, and is turned off when shifts is not made to the first power saving state, to thereby inform the user as to whether the adhesive bookbinding machine 500 is in the first power saving state. In the present embodiment, the post-processing power saving key 700 serves also as means for manually shifting the adhesive bookbinding machine to the first power saving state, means for manually returning the adhesive bookbinding machine from the first power saving state, and means for informing the user as to whether the adhesive bookbinding machine is in the first power saving state. Also, the post-processing power saving key 700 is provided on the adhesive bookbinding machine 500, but may be provided on the image forming apparatus 10. Further, it never happens that the image forming apparatus 10 shifts to a power saving state by the post-processing power saving key 700 being depressed to thereby shift the adhesive bookbinding machine 500 to the first power saving state.

Description will now be made of the flow of a series of bookbinding operations in the adhesive bookbinding machine 500. In a bookbinding mode, the sheet stacking portion A stacks on a stacking tray recording sheets discharged from the image forming apparatus 10, and makes a sheet bundle 540. The sheet stacking portion A moves the sheet bundle 540 to the pasting portion B. The pasting portion B effects the application of paste to the underside of the sheet bundle 540 by a paste container 525, a paste applying roller 524 and a paste applying roller control motor 522. The paste container 525 is provided with a heater (not shown), which melts the paste.

The adhesively securing portion C executes the step of adhesively securing the pasted sheet bundle 540 to a cover P discharged from the image forming apparatus 10, and delivering it as a brochure 570 to a trim gripper 512. The brochure 570 is conveyed to the paper cutting portion D by the trim gripper 512. The paper cutting portion D moves a cutter 528 in a horizontal direction by a cutter control motor 527 to thereby effect the cutting of the brochure 570. The cutting waste falls into a waste receiving box 533. When a series of paper cutting operations are completed, the cutting waste in the waste receiving box 533 is collected into a waste box 532. The brochure 570 having been cut by the paper cutting portion D is conveyed from the paper cutting portion D to a bound book discharging portion E, and the brochure 570 is discharged.

The adhesive bookbinding machine 500 can select, besides the above-described series of bookbinding operations in the bookbinding mode, an ordinary discharging mode in which bookbinding is not effected, but the sheets are discharged to the post-processing apparatus on the downstream side. Specifically, downstream of a pair of conveying rollers 505, there is provided a changeover flapper 521, which selectively directs the sheet, conveyed from the pair of conveying rollers 505 to the sheet stacking tray 520 or the post-processing apparatus 400 side. In the first power saving state, electric power supply to a mechanism for conveying the sheet to the post-processing apparatus 400 side is maintained.

In the bookbinding mode, the sheet P discharged from the image forming apparatus 10 is discharged to the sheet stacking tray 520 by pairs of conveying rollers 506, 507 and 508 and the discharge rollers 509 of the stacking portion. A plurality of sheets are stacked on the sheet stacking tray 520, and are aligned to thereby provide a sheet bundle 540. On the other hand, in the ordinary discharging mode, the sheet P discharged from the image forming apparatus 10 is discharged to the post-processing apparatus 400 by pairs of conveying rollers 505, 510, 511, 513 and 514 and sheet discharge rollers 515. The construction and operation of this post-processing apparatus will be described later.

Also, an inserter 300 is provided on the upper surface of the adhesive bookbinding machine 500. The inserter 300 can convey the sheets placed on a tray 310 by rollers 301 and 302 and pairs of rollers 303, 503 and 504, and insert (slip-sheet) them into between the sheets discharged from the image forming apparatus 10.

(Finisher)

Figure 3:
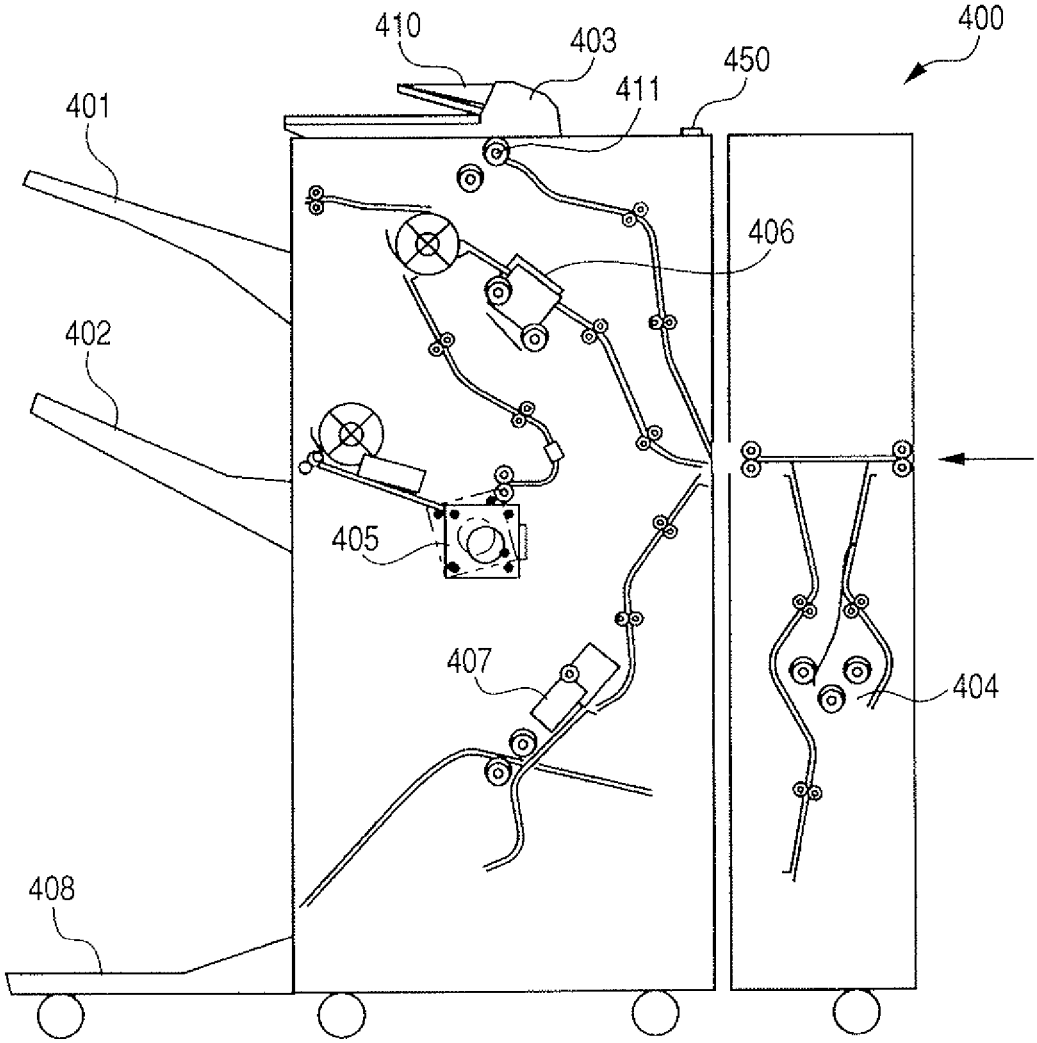
FIG. 3 shows the internal construction of a finisher 400.

FIG. 3 shows the internal construction of a finisher 400. This post-processing apparatus (finisher) 400 is connected as the downstream apparatus of the adhesive bookbinding machine 500, and effects post-processing including for example, a bundle discharging process, a binding process, a folding process and a bookbinding process.

The finisher 400 has a Z folding machine 404, a puncher 406, a stapler 405, a saddle stitcher 407 and an inserter 403. The finisher 400 carries out the post-processing on the sheets carried in from the adhesive bookbinding machine 500 side and discharges them to a sample tray 401, a stack tray 402 or a booklet tray 408.

The stapler 405 can also store the sheets before discharged in each job when the sheets are to be discharged to the stack tray 402, and bind them immediately before discharged. The Z folding machine 404 folds the sheets into a Z-shape (folds in three). The puncher 406 makes two or three holes for filing in the sheets.

The saddle stitcher 407 carries out the process of binding the central portion of the sheets at two locations, and thereafter making the central portion of the sheets nipped by rollers to thereby half-fold the sheets, and make a booklet such as a weekly or a brochure. The sheets bound by the saddle stitcher 407 are discharged onto a booklet tray 408.

The inserter 403 can directly convey the sheets set on the tray 410 to one of the tray 401, 402 and 408. That is, the sheets set on the inserter 403 can be inserted (slip-sheeted) between the sheets fed into the finisher 400. When the user sets the sheets on the tray 410 of the inserter 403 in the face-up state, the sheets are fed in succession from the uppermost sheet by a pickup roller 411. The sheets from the inserter 403 are intactly conveyed to the trays 401 and 402, and are discharged in a face-down state. When the sheet is to be conveyed to the saddle stitcher 407, the sheet is once fed to the puncher 406 side, and thereafter is switched back and the front and back of the sheet are reversed, and the sheet is conveyed into the saddle stitcher. Thereby, the surface of the sheets fed in from the adhesive bookbinding machine and the orientation of the face of the sheets conveyed from the inserter 403 come into coincidence with each other.

Also, on the upper surface of the finisher 400, there is disposed a post-processing power saving key 450 for instructing the user to manually effect the shift to the first power saving state and the return from the first power saving state. Also, this post-processing power saving key 450, like the aforedescribed post-processing power saving key 700, is changed over in its ON/OFF of the power saving function each time it is depressed. Also, an LED is provided in it. Also, the post-processing power saving key 450 is turned on when shift is made to the first power saving state, and is turned off when shift is not made to the first power saving state, to thereby inform the user as to whether the finisher is in the first power saving state.

The finisher 400, when in the first power saving state, renders the electric power supplied to such loads as the Z folding machine 404, the puncher 406, the stapler 405, the saddle stitcher 407 and the inserter 403. However, even in the first power saving state, it can discharge the sheet carried in intactly to the sample tray 401. That is, the electric power supply to a conveying mechanism to the sample tray 401 is maintained.

In the present embodiment, the post-processing power saving key 450 is provided on the finisher 400, but may be provided on the image forming apparatus 10.

(Operation Portion)

Figure 4:
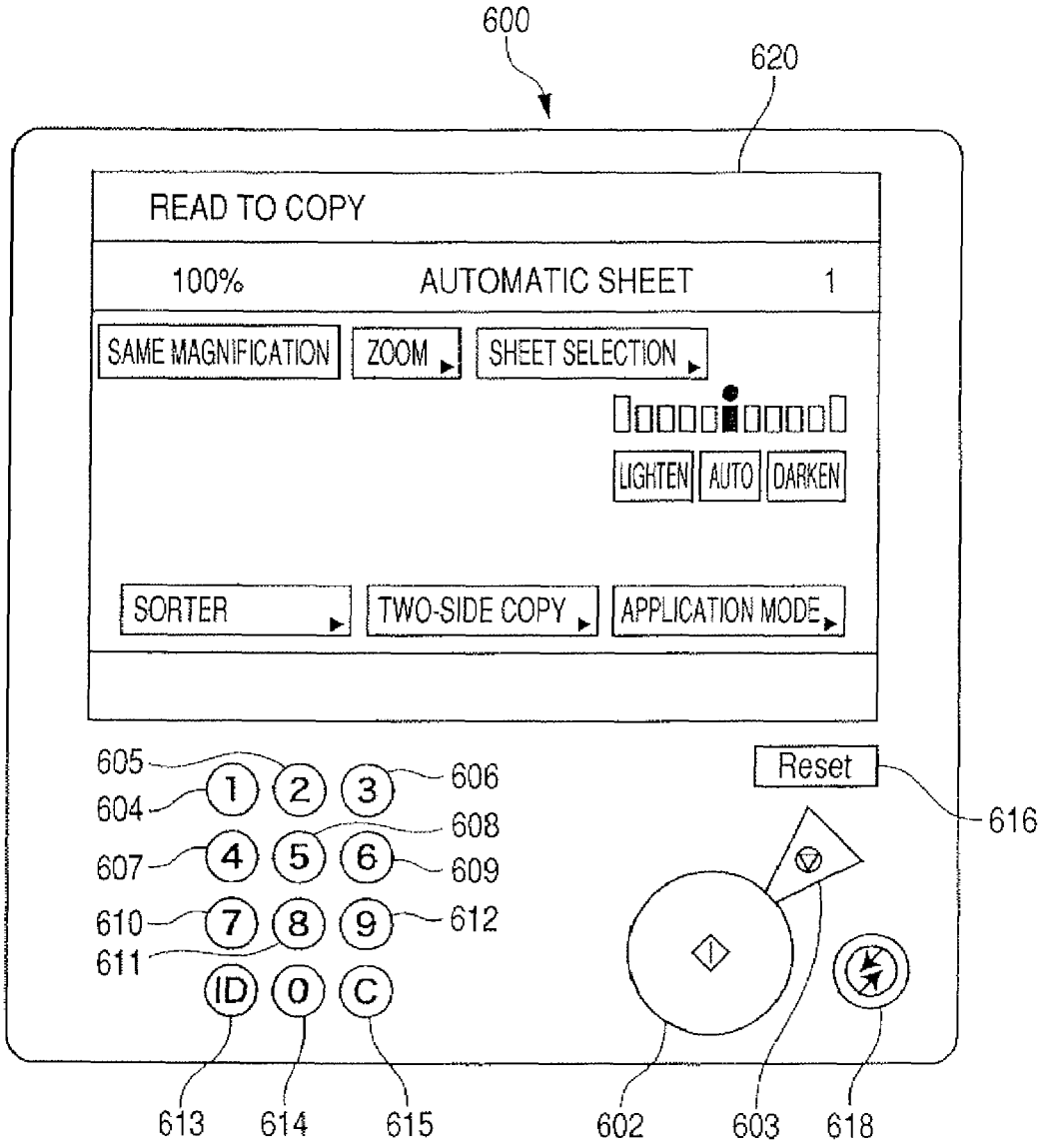
FIG. 4 shows the appearances of an operation portion 600.

FIG. 4 shows the appearances of the operation portion 600. The operation portion 600 has a construction in which a liquid crystal display portion 620 is disposed in the upper portion thereof and various keys are disposed in the lower portion thereof. As the various keys, provision is made of a start key 602, a stop key 603, ten-keys 604 to 612 and 614, an ID key 613, a clear key 614, a reset key 616, a system power saving key 618, etc. The start key 602 is a key for starting an image forming operation. The stop key 603 is a key for interrupting the image forming operation. The ten-keys 604 to 612 and 614 are keys for effecting numeral setting or the like. The system power saving key 618 is a key for shifting the entire image forming system to the power saving state and returning it from the power saving state.

Also, a touch panel is provided on the screen of the liquid crystal display portion 620, and various soft keys are prepared. For example, the image forming system has, as the post-processing modes of the post-processing apparatus 400 and the adhesive bookbinding machine 500, such processing modes as a non-sorting mode, a sorting mode and a bookbinding mode and therefore, on the screen, there are displayed various soft keys for setting such processing modes. By the inputting operation of these soft keys, a corresponding processing mode is set.

(Control Portion)

Figure 5:
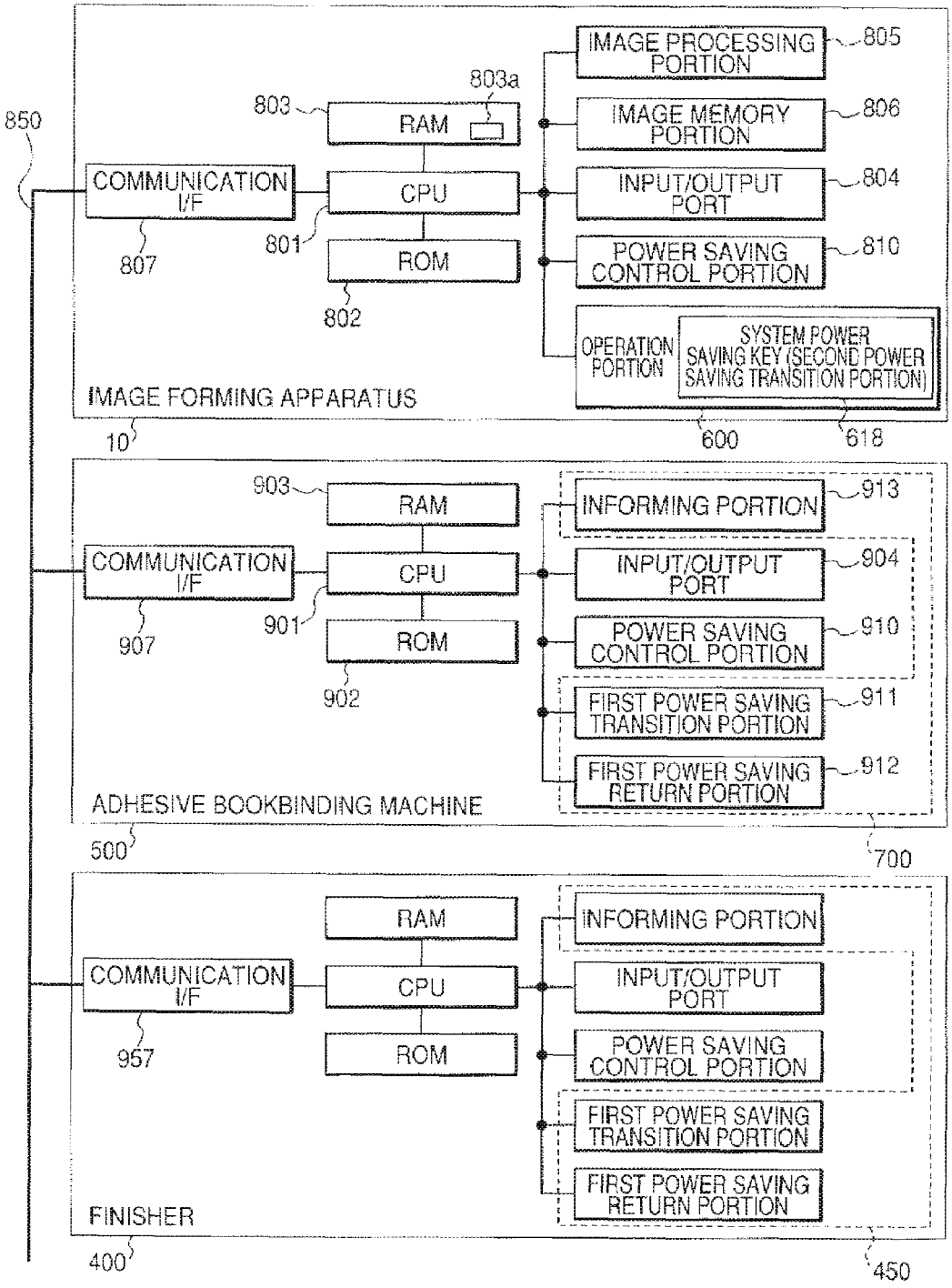
FIG. 5 is a block diagram showing the constructions of control portions in an image forming apparatus 10 and a plurality of post-processing apparatuses.

FIG. 5 is a block diagram showing the construction of each control portion (CPU) in the image forming apparatus 10 and a plurality of post-processing apparatuses. In the control portion in the image forming apparatus 10, there are provided, besides a CPU 801, a ROM 802, a RAM 803 and an input/output port 804, an image processing portion 805, an image memory portion 806, a power saving control portion 810 and the operation portion 600, and these are connected together an address bus and a data bus. Also, a communication interface (I/F) 807 is connected to the CPU 801. The communication interface (I/F) 807 is connected to a communication interface in each post-processing apparatus through a communication cable 850. The CPU 801 can communicate with a CPU in each post-processing apparatus through this communication interface (I/F) 807.

The CPU 801 effects the basic control of the image forming apparatus 10. A control program executed by the CPU 801 is written in the ROM 802. The RAM 803 has a work area when the CPU 801 executes the program. Also, some area of the RAM 803 is a backup RAM in which data is not erased even if the power supply is rendered OFF. Also, as will be described later, a first power saving transition counter 803*a* used for time measurement is allotted to the RAM 803 in each of the post-processing apparatuses (the adhesive bookbinding machine 500 and the finisher 400). Various loads such as a motor and a clutch, and an input device such as a sensor for detecting the position of the sheet are connected to the input/output port 804.

The CPU 801 sequentially effects input/output control through the input/output port 804 in accordance with the control program stored in the ROM 802, and executes the image forming process. Also, the CPU 801 controls the liquid crystal display portion 620 and the various keys in the operation portion 600. The various keys include, as a second power saving transition portion, a system power saving key 618 for shifting the entire image forming system to the power saving state.

When the user depresses the system power saving key 618, instructions to the power saving control portion 810 or instructions to switch the display are given by the CPU 801. The power saving control portion 810 power-saves the entire image forming system so as to assume a second power saving state lower in power consumption than the first power saving state. In this second power saving state, the image forming apparatus 10 also enters the power saving state, and electric power supply to a mechanism for the delivery conveying operation or the discharge conveying operation in the post-processing apparatus may be rendered OFF. Also, in accordance with the instructions, the CPU 801 effects the control of displaying the operative state of the image forming apparatus 10 or an operation mode set by a key input on the liquid crystal display portion 620 of the operation portion 600.

Also, the image processing portion 805 processes a signal converted into an electrical signal by the image sensor 109. Images processed by the image processing portion 805 are accumulated in the image memory portion 806.

On the other hand, in the control portion in the adhesive bookbinding machine 500, there are provided, besides a CPU 901, a ROM 902, a RAM 903 and an input/output port 904, an informing portion 913, a power saving control portion 910, a first power saving transition portion 911 and a first power saving return portion 912, and these are connected together through an address bus and a data bus. In the present embodiment, the first power saving transition portion 911, the first power saving return portion 912 and the informing portion 913 are realized by a post-processing power saving key 700 with a self-illumination function. Also, a communication interface (I/F) 907 is connected to the CPU 901.

The CPU 901 effects the basic control of the adhesive bookbinding machine 500. A control program to be executed by the CPU 901 is written in the ROM 902. The RAM 903 has a work area for the CPU 901 to execute the program. Also, some area of the RAM 903 is a backup RAM in which data is not erased even if the power supply is rendered OFF. Also, various load devices such as clutches and an input device such as a sensor for detecting the position of the sheet are connected to the input/output port 904.

When the user depresses the post-processing power saving key 700, instructions to the power saving control portion 910 are given by the CPU 901. In accordance with the instructions, the power saving control portion 910 shifts the adhesive bookbinding machine 500 to the power saving state, but does not shift the image forming apparatus 10 and other sheet post-processing apparatuses to the power saving state. That is, the post-processing power saving key 700 does not affect the power saving state of the image forming apparatus 10 and other sheet post-processing apparatuses. Also, the CPU 901 effects the control of displaying the power saving state of the adhesive bookbinding machine 500 on the informing portion 913.

Also, the communication I/F 907 is connected to the communication I/F 807 in the image forming apparatus 10 and a communication I/F 957 in the finisher 400 which is another post-processing apparatus through a communication cable 850. Accordingly, the CPUs in the respective apparatuses can mutually transmit information the respective apparatuses have, through the communication I/Fs 807, 907, 957, etc. The construction of the control portion of the finisher 400 is similar to that of the control portion of the adhesive bookbinding machine 500 and therefore need not be described.

Figure 6:
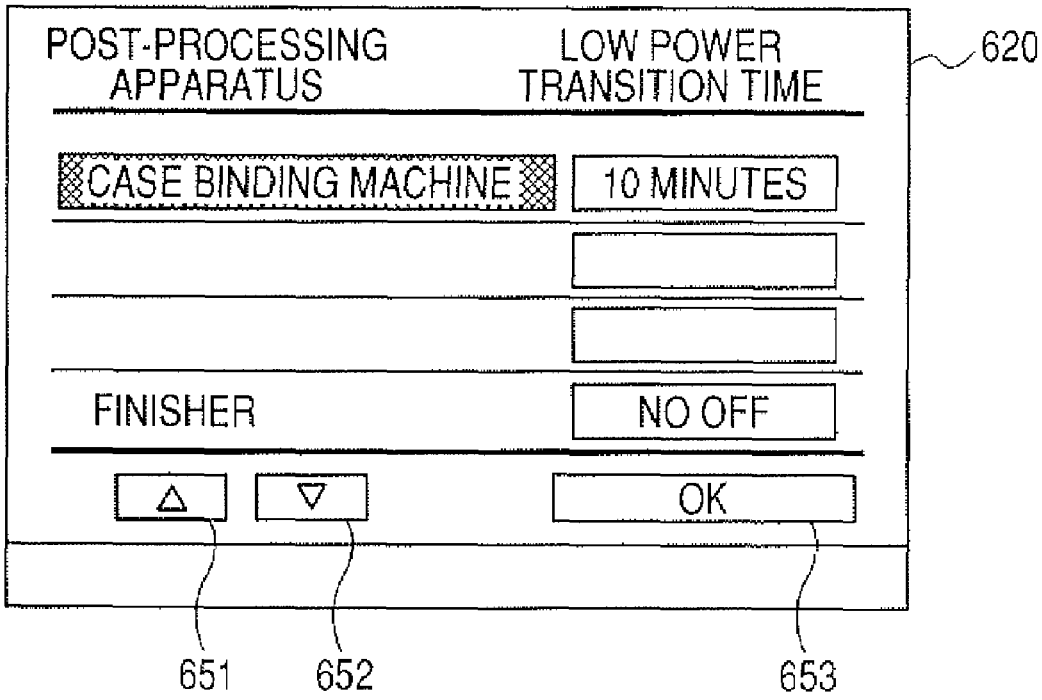
FIG. 6 shows the set image screen of a first power saving transition time.

The power saving operation of the image forming system having the above-described construction will now be described. FIG. 6 shows the set screen of a first power saving transition time. This set screen is displayed on the liquid crystal display portion 620 of the operation portion 600. On this set screen, the first power saving transition time can be set for each post-processing apparatus (case binding machine, finisher) connected to the image forming apparatus 10. The post-processing apparatus which is the object to be set is selected by touching the characters of the name of the post-processing apparatus on the screen of the liquid crystal display portion 620. To the selected post-processing apparatus, time setting becomes possible by the operation of an upward arrow key 651 and a downward arrow key 652. When for example, the first power saving transition time is set to "10 minutes", shift is made to the first power saving state in 10 minutes after the post-processing has been completed. When the first power saving transition time is set to "NO OFF", the auto power saving the transition operation by the count-up of the first power saving transition time becomes ineffective. Also, by an OK key 653 being depressed, the set time is decided.

FIG. 7 is a flow chart showing the power saving control processing procedure in the image forming system. This processing program is stored in the ROM 802 in the image forming apparatus 10, and is executed by the CPU 801. Also, this processing program is executed to each post-processing apparatus, and in a case where a plurality of post-processing apparatuses are connected, it is repetitively executed. In the present embodiment, it is repetitively executed in the order of the adhesive bookbinding machine 500 and the finisher 400, but here is specifically shown a case where it is executed to the adhesive bookbinding machine 500.

First, the CPU 801 discriminates whether the system power saving key 618 has been depressed and there is a request for the power saving of the image forming system (a request for the shift to the second power saving state)(step S1). If there is not the request for the power saving of the image forming system, the CPU 801 discriminates the presence or absence of the performance of the post-processing operation (here, the bookbinding operation) (step S2). If the post-processing operation is performed, the CPU 801 clears a first power saving transition counter 803*a* (a counter corresponding to the adhesive bookbinding machine)(step S4), thus completing the present processing.

On the other hand, if at the step S2, the post-processing operation is not performed, the CPU 801 discriminates whether the post-processing power saving key 700 is ON (step S3). This discrimination is effected by the CPU 801 in the image forming apparatus 10 acquiring the ON/OFF information of the post-processing power saving key 700 informed from the CPU 901 through the communication cable 850, the communication interface 907, etc. If the post-processing power saving key 700 is ON, the CPU 801 shifts the post-processing apparatus (adhesive bookbinding machine 500) to the first power saving state (step S6).

On the other hand, if at the step S3, the post-processing power saving key 700 is OFF, the CPU 801 discriminates whether the time counted by the first power saving transition counter 803*a* has reached a first power saving transition time (step S5). Here, the time counting by the first power saving transition counter 803*a* is started simultaneously with the ON of the power supply of the image forming system, and is cleared as long as the system is in the first and second power saving states. If at the step S5, the first power saving transition time has elapsed, at a step S6, the CPU 801 shifts the post-processing apparatus to the first power saving state. On the other hand, if at the step S5, the first power saving transition time has not elapsed, the present processing is terminated. Even if the present processing is terminated, the time counting using the first power saving transition counter 803*a* is continued.

The adhesive bookbinding machine 500, when switched to the first power saving sate, changes over the changeover flapper 521 so as to direct the sheet conveyed from the image forming apparatus 10 to the post-processing apparatus 400 side. When the sheet is discharged from the image forming apparatus 10 during the first power saving state, the sheet P is discharged to the post-processing apparatus 400 side by the pairs of conveying rollers 505, 510, 511, 513 and 514 and the discharge rollers 515. At this time, electric power is not supplied to such loads as the sheet stacking portion A, the pasting portion B, the adhesively securing portion C, the paper cutting portion D and the bookbinding discharge portion E.

The CPU 801 discriminates whether the post-processing power saving key 700 has been depressed and rendered OFF during the first power saving state (step S7). When the post-processing power saving key 700 has been rendered OFF, the CPU 801 effects the power saving return process of shifting the post-processing apparatus to a post-processing standby state (step S8). Thereafter, the present processing is ended.

On the other hand, if at the step S7, the post-processing power saving key 700 remains ON, the CPU 801 discriminates whether there is a request for performing the post-processing operation (here, the bookbinding operation) (step S9). If there is the request for performing the post-processing operation, at the step S8, the CPU 801 shifts the post-processing apparatus to the post-processing standby state.

On the other hand, if at the step S9, there is not the request for performing the post-processing operation, the CPU 801 discriminates whether there is a request for the power saving of the image forming system by the depression of the system power saving key 618 (step S10) If there is not the request for the power saving of the image forming system, the present processing is ended while the first power saving state remains maintained. On the other hand, if at the step S10, there is the request for the power saving of the image forming system, the CPU 801 shifts the image forming system to the second power saving state (step S11).

The CPU 801 discriminates the presence or absence of a request for returning the power saving of the image forming system during the second power saving state (step S12). If there is the request for returning the power saving of the image forming system, at the step S8, the CPU 801 shifts the entire image forming system to the post-processing standby state. On the other hand, if at the step S12, there is not the request for returning the power saving of the image forming system, the present processing is ended while the second power saving state remains maintained. In this second power saving state, the check-up of the post-processing power saving key 700 is not effected, that is, the processing of the step S1, S11 and S12 is repeated as long as the image forming system is in the second power saving state, and therefore, even if the post-processing power saving key 700 is depressed, return is not made from the first power saving state. That is, the post-processing power saving key 700 becomes ineffective.

When the power saving control process shown in the flow chart of FIG. 7 is executed to the adhesive bookbinding machine 500, the power saving control process is subsequently executed to the finisher 400. However, when the power saving control process is executed to the finisher 400, the first power saving transition time (see FIG. 6) is set to "OFF" and therefore, the process at the step S5 of discriminating whether the first power saving transition time has elapsed always become NO.

As described above, according to the image forming system of the present embodiment, power saving efficiency can be enhanced even during the image forming operation by the post-processing apparatuses being individually shifted to the power saving state. Also, only a particular post-processing apparatus can be singly shifted to the power saving state and therefore, power saving according to the situation of use becomes possible without the post-processing apparatuses which are temporarily not used being completely rendered into an OFF state. Also, the user's way to use can be improved.

Also, the plurality of post-processing apparatus connected together in series can be individually shifted to the power saving state, and the user need not be conscious of the power saving state of the post-processing apparatus in the course of the conveyance route of the sheet which effects only the delivery of the sheet.

Also, by the self-illumination function of the post-processing power saving key, the user can recognize the post-processing apparatus which has been shifts to the first power saving state, and can easily effect the shift to and return from the first power saving state. Also, even if the user does not grasp the situation of the use of the post-processing apparatuses, the user can automatically shift the post-processing apparatuses to the first power saving state. Also, the user can arbitrarily set the time for automatically shifting the post-processing apparatuses to the first power saving state. Also, the user can manually arbitrarily shift the post-processing apparatuses to the first power saving state. Also, the user can start the post-processing (outputting) operation without being conscious of the power saving state of the post-processing apparatus to which the sheet is discharged.

Also, even in a case where the return time until the post-processing apparatus becomes usable from the first power saving state is long, during the executing of a job which does not use the post-processing apparatus being in the first power saving state, the user returns that post-processing apparatus from the first power saving state beforehand, whereby the post-processing (outputting) operation becomes possible substantially without waiting for the returning time. Specifically, in the adhesive bookbinding machine, when in the first power saving state, the temperature control of the paste is rendered OFF, the returning time until adhesive bookbinding becomes possible becomes long. Accordingly, the user grasps a job schedule, and returns the adhesive bookbinding machine from the first power saving state during the execution of a job which does not use the adhesive bookbinding machine, whereby the adhesive bookbinding (outputting) operation becomes possible without waiting for the returning time.

Also, by providing a post-processing power saving key in each post-processing apparatus, the user can visually easily understand which post-processing apparatus has been shifted to the first power saving state, and can concentrate the manually power saving shifting, the manually power saving returning and informing functions in the post-processing apparatuses.

Also, when the entire image forming system is to be shifted to the power saving state, electric power consumption can be further suppressed. Also, even if the return is instructed by the user's wrong operation in a state in which shift is made to the second power saving state, the single body of the post-processing apparatus can be prevented from being meaninglessly returned from the power saving state. Also, by the present invention being applied to an adhesive bookbinding machine consuming much electric power, the power saving effect can be enhanced.

While in the present embodiment, there has been shown the power saving control process in a case where two post-processing apparatuses are connected together in tandem, processing is likewise possible in a case where three or more post-processing apparatuses are connected together. For example, it is also possible to connect two stackers together in tandem between the adhesive bookbinding machine and the finisher.

Figure 8:
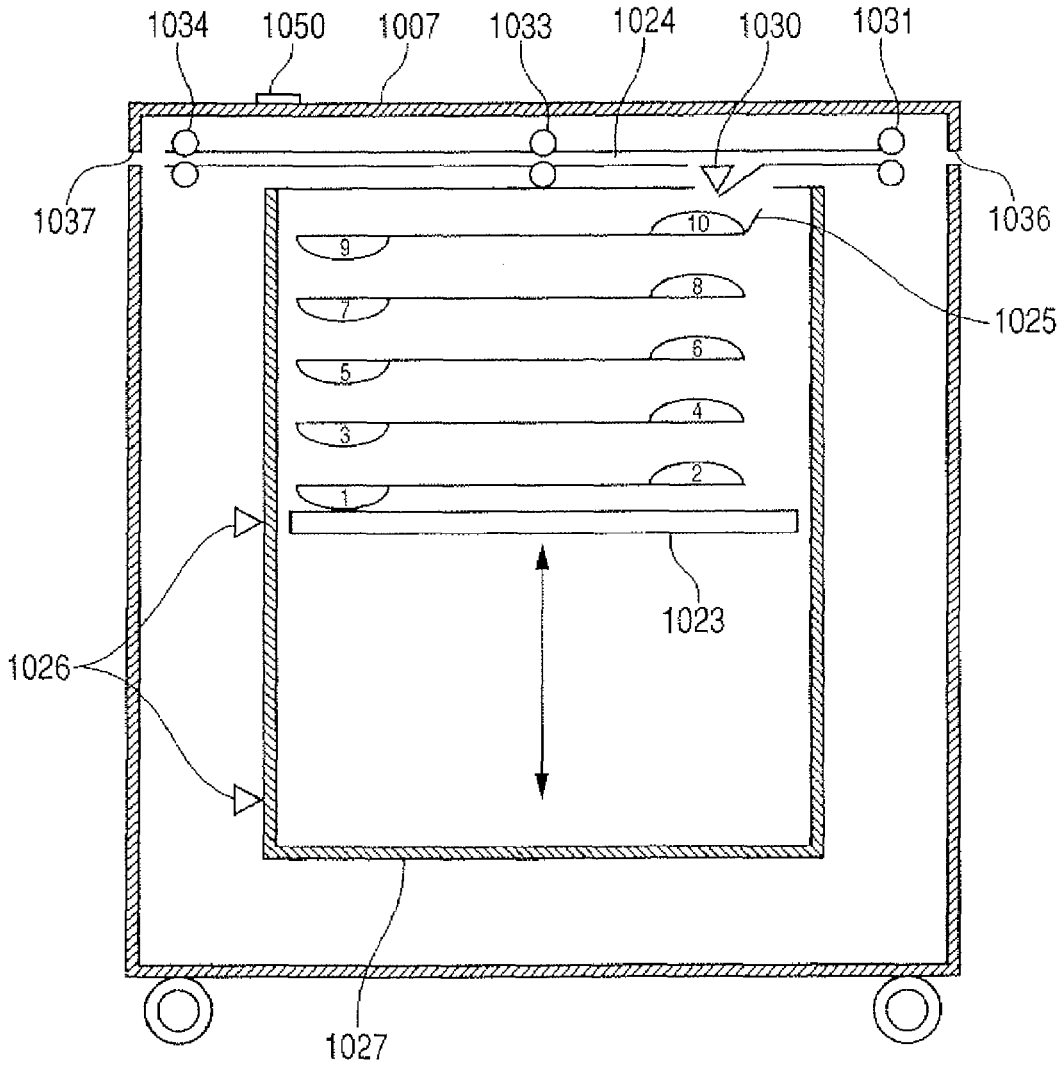
FIG. 8 shows the internal construction of a stacker.

FIG. 8 shows the internal construction of the stacker. The two stackers have the same construction and therefore, only one of them is shown. In the stacker 1007, there is contained a stacker tray 1027 on which sheets are stacked. Also, the stacker 1007 is provided with a plurality of pairs of rollers 1031, 1033 and 1034 along a conveying path from the inlet 1036 thereof to the discharge port 1037. Further, a changeover flapper 1030 is provided on a conveying path on the inlet 1036 side. The changeover flapper 1030 changes over the conveyance direction of the sheet conveyed by the pair of rollers 1031 to the stacker tray 1027 side or the discharge port 1037 side.

A lifter apparatus provided in the stacker tray 1027 has a lifter portion 1023, a sheet surface detecting sensor 1025, a lifter position detecting sensor 1026 and a mechanism (not shown) for driving the lifter portion. The lifter portion 1023 controls the spacing between a conveying path 1024 and the sheet surface so as to be kept constant, on the basis of the output of the sheet surface detecting sensor 1025 for detecting the position of the uppermost sheet surface, and improves the stack-ability of the sheets. The mechanism for driving the lifter portion 1023 transmits the driving force of a motor to a gear for taking up a wire connected to the lifter portion 1023. The lifter position detecting sensor 1026 detects the position of the lifter portion 1023 to thereby detect the sheet stack amount on the stacker tray 1027.

Also, on the upper surface of the stacker 1007, there is disposed a post-processing power saving key 1050 for instructing the user to manually shift the post-processing apparatus to and return it from the first power saving state. Also, each time this post-processing power saving key 1050, like the aforedescribed post-processing power saving key 700, is depressed, the power saving state changes over to ON/OFF. Also, the post-processing power saving key 1050 has a self-illumination function. The post-processing power saving key 1050 is turned on when the post-processing apparatus is shifted to the first power saving state, and is turned off when it is not shifted to the first power saving state, and thereby informs the user as to whether the post-processing apparatus is in the first power saving state. The post-processing power saving key 1050 may be provided on the image forming apparatus 10.

Also, as regards the stacker 1007, in the first power saving state, electric power is not supplied to the lifter apparatus 1023, but in order to deliver the sheet to the downstream apparatus, electric power is supplied to a driving mechanism for the flapper 1030 and the plurality of pairs of rollers 1031, 1033 and 1034.

Even in a case where two stackers having the above-described construction are connected together in series between the adhesive bookbinding machine 500 and the finisher 400, the power saving control process shown in the aforedescribed flow chart of FIG. 7 is executed. That is, as the post-processing apparatuses, processing is repeated in the order of the adhesive bookbinding machine 500, the fist stacker, the second stacker and the finisher 400, whereby desired power saving control is realized.

Figure 9:
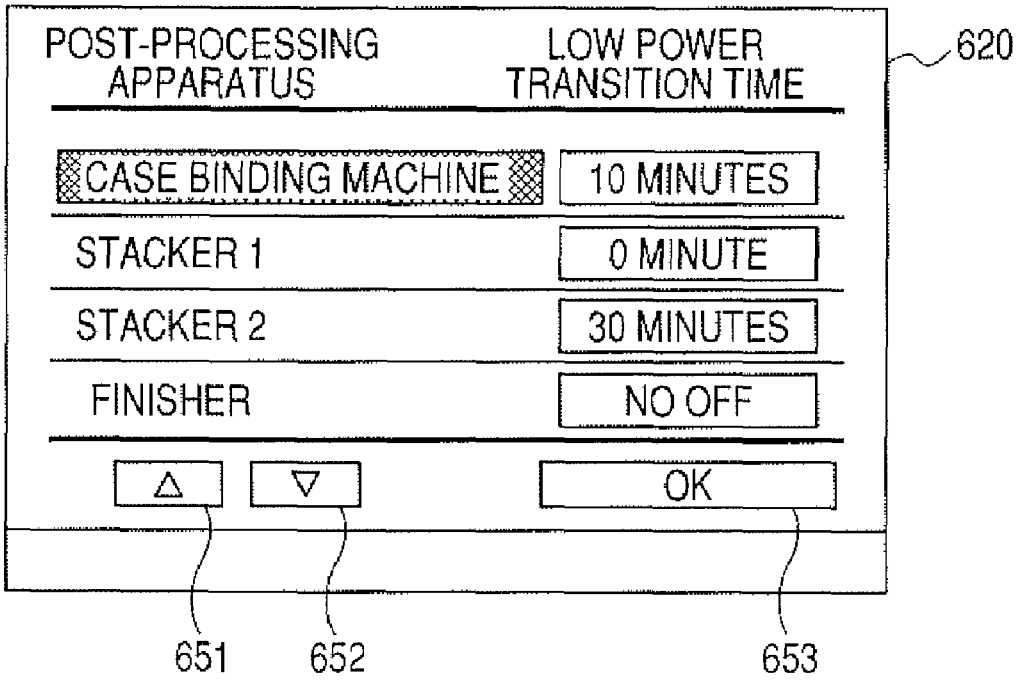
FIG. 9 shows the set image screen of the first power saving transition time when two stackers are connected together between the adhesive bookbinding machine and the finisher.
Figure 10:
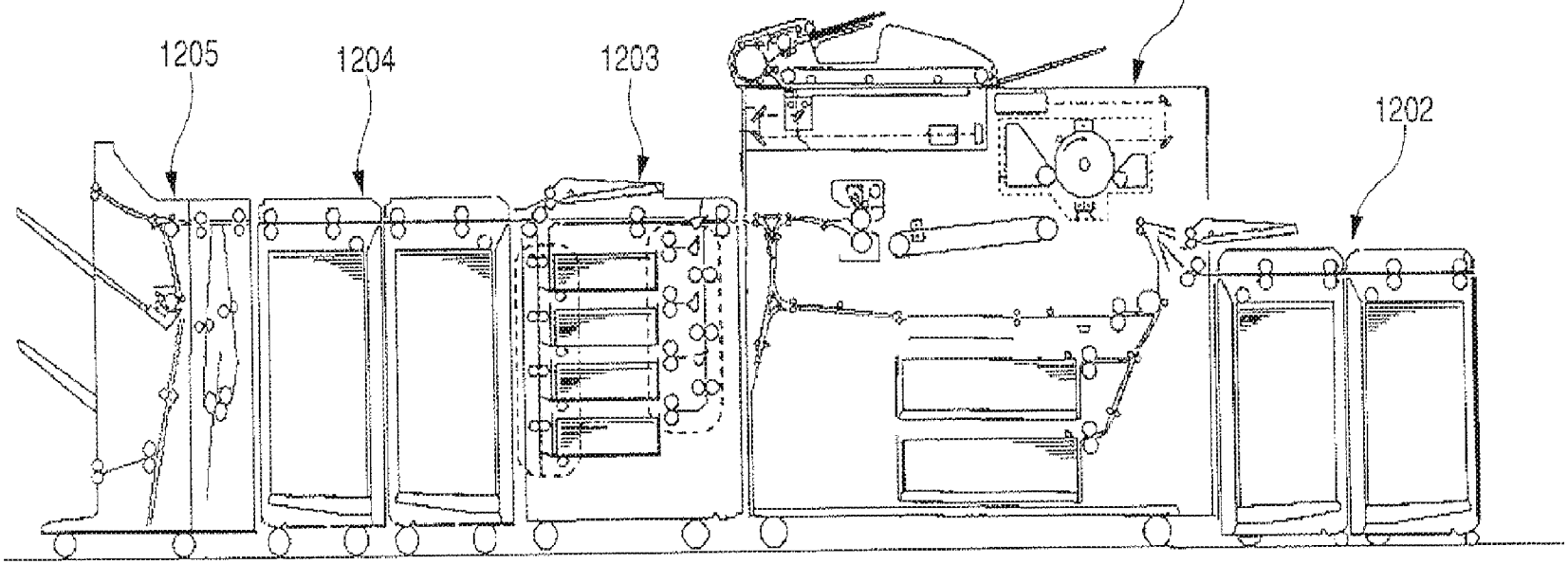
FIG. 10 (PRIOR ART)
FIG. 10 schematically shows the construction of a conventional large-scale image forming system.

FIG. 9 shows a set screen for the first power saving transition time when two stackers are connected together in tandem between the adhesive bookbinding machine and the finisher. This set screen, as in FIG. 6, is displayed on the liquid crystal display portion 620 of the operation portion 600. In this set screen, the first power saving transition time can be set on the case binding machine, the first stacker, the second stacker and the finisher connected to the image forming apparatus 10.

The post-processing apparatus which is the object to be set is selected by touching the characters of the name of the corresponding post-processing apparatus on the screen of the liquid crystal display portion 620. For the selected post-processing apparatus, time setting becomes possible by the operation of the upward arrow key 651 and the downward arrow key 652. When for example, the first power saving transition time of the first stacker is set to "0 minute", shift is made to the first power saving state immediately after the execution of the post-processing. When the first power saving transition time is set to "NO OFF", the auto power saving transition operation by the counting-up of the first power saving transition time becomes ineffective, as previously described. Also, by depressing the OK key 653, the set time is decided.

Also, while the adhesive bookbinding machine, the stacker and the finisher have been exemplarily shown as the post-processing apparatuses constituting the image forming system having the power saving control function, these are of course not restrictive. For example, a staple stacker for carrying out a stapling process on a sheet bundle, a paper cutting apparatus capable of collectively cutting a great deal of paper, a fixing post-processing apparatus for making an output image higher in quality, etc. may be connected as the post-processing apparatuses.

The present invention is not restricted to the construction of the above-described embodiment, but is applicable to any construction which can achieve the function shown in the appended claims, or the function the construction of the present embodiment has.

The object of the present invention can also be achieved by supplying a system or an apparatus with a storage medium having recorded therein the program code of software for realizing the function of the embodiment, and the computer (or the CPU, MPU or the like) of the system or the apparatus reading out and executing the program code stored in the storage medium.

In this case, the program code itself read out from the storage medium realizes the function of the aforedescribed embodiment, and the program code and the storage medium storing the program code therein constitute the present invention.

Also, as the storage medium for supplying the program code, use can be made, for example, of a Floppy (registered trademark) disk, a hard disk, a magneto-optical disk, a CD-ROM, a CD-R, a CD-RW, a DVD-ROM, a DVD-RAM, a DVD-RW, a DVD+RW, a magnetic tape, a non-volatile memory card, a ROM or the like. Alternatively, the program code may be down-loaded through a network.

Also, there is covered a case where by executing the program code read out by the computer, not only the function of the above-described embodiment is realized, but on the basis of the instructions of the program code, an operating system (OS) or the like binding on the computer carries out part or the whole of the actual processing, and by that processing, the function of the aforedescribed embodiment is realized.

Further, there is also covered a case where the program code read out from the storage medium is written into a memory provided in a function expanding board inserted in the computer or a function expanding unit connected to the computer, thereafter on the basis of the instructions of the program code, a CPU or the like provided in the function expanding board or the function expanding unit carries out part or the whole of the actual processing, and by that processing, the function of the aforedescribed embodiment is realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-250115, filed Aug. 30, 2005, which is hereby incorporated by reference herein in its entirety.

What is claimed is:

1. An image forming system having an image forming apparatus and a sheet post-processing apparatus for carrying out post-processing on a sheet, comprising:

a first power saving control portion which shifts said sheet post-processing apparatus into a first power saving state without affecting a power saving state of said image forming apparatus; and a second power saving control portion which shifts said image forming apparatus and said sheet post-processing apparatus into a second power saving state smaller in electric power consumption than said first power saving state, wherein in said first power saving state, said sheet post-processing apparatus is incapable of executing sheet post-processing and is capable of executing sheet conveyance, and in said second power saving state, said sheet post-processing apparatus is incapable of executing the sheet post-processing and the sheet conveyance.

2. An image forming system according to claim 1, further comprising a power saving instruction key which inputs instructions for manually shifting said sheet post-processing apparatus into said first power saving state, wherein said first power saving control portion shifts said sheet post-processing apparatus into said first power saving state in accordance with input of said power saving instruction key.

3. An image forming system according to claim 2, wherein said second power saving control portion renders the input of said power saving instruction key ineffective during said second power saving state.

4. An image forming system according to claim 1, wherein said first power saving control portion has a timer device which measures a time for which said sheet post-processing apparatus is not operated, and when the time measured by said timer device has reached a first power saving transition time, said sheet post-processing apparatus is shifted to said first power saving state.

5. A power saving control method in an image forming system having an image forming apparatus and a sheet post-processing apparatus for carrying out post-processing on a sheet, comprising:

a first power saving control step of shifting said sheet post-processing apparatus into a first power saving state without affecting a power saving state of said image forming apparatus; and a second power saving control step of shifting said image forming apparatus and said sheet post-processing apparatus into a second power saving state smaller in electric power consumption than said first power saving state, wherein in said first power saving state, said sheet post-processing apparatus is incapable of executing sheet post-processing and makes sheet conveyance possible, and in said second power saving state, said sheet post-processing apparatus is incapable of executing sheet post-processing and sheet conveyance.

* * * * *